US007918162B2

(12) United States Patent
Möhringer et al.

(10) Patent No.: US 7,918,162 B2
(45) Date of Patent: Apr. 5, 2011

(54) APPARATUS FOR TRANSPORTING SHEETS WITH A GRIPPER DEVICE

(75) Inventors: Markus Möhringer, Weinheim (DE); Burkhard Wolf, Dossenheim (DE)

(73) Assignee: Heidelberger Druckmaschinen AG, Heidelberg (DE)

( * ) Notice: Subject to any disclaimer, the term of this patent is extended or adjusted under 35 U.S.C. 154(b) by 882 days.

(21) Appl. No.: 11/711,798

(22) Filed: Feb. 27, 2007

(65) Prior Publication Data

US 2007/0199464 A1 Aug. 30, 2007

(30) Foreign Application Priority Data

Feb. 27, 2006 (DE) ..... 10 2006 008 659

(51) Int. Cl.
*B41F 27/12* (2006.01)
*B41F 21/00* (2006.01)

(52) U.S. Cl. ..... 101/409; 101/415.1; 101/246; 271/277

(58) Field of Classification Search ..... 101/408–409, 101/415.1, 246; 271/82, 277
See application file for complete search history.

(56) References Cited

U.S. PATENT DOCUMENTS

| | | | | |
|---|---|---|---|---|
| 5,678,486 | A * | 10/1997 | Bachmeir et al. | 101/409 |
| 5,711,220 | A * | 1/1998 | Calbrix et al. | 101/246 |
| 6,089,157 | A * | 7/2000 | Becker et al. | 101/230 |
| 6,186,499 | B1 * | 2/2001 | Gross | 271/277 |
| 6,349,935 | B1 | 2/2002 | Boguhn et al. | 271/265.01 |
| 6,659,008 | B2 * | 12/2003 | Mutschall et al. | 101/409 |

FOREIGN PATENT DOCUMENTS

| | | |
|---|---|---|
| CH | 151 698 | 12/1931 |
| DE | 198 31 976 A1 | 1/2000 |
| DE | 100 13 611 A1 | 9/2001 |
| DE | 102 18 172 A1 | 11/2003 |
| GB | 676 218 | 7/1952 |

* cited by examiner

*Primary Examiner* — Ren Yan
*Assistant Examiner* — Marissa L Ferguson-Samreth
(74) *Attorney, Agent, or Firm* — Laurence A. Greenberg; Werner H. Stemer; Ralph E. Locher

(57) ABSTRACT

An apparatus for transporting sheets to or in a sheet-processing machine includes a gripper device having at least one gripper with a gripper housing and a gripper pad. The gripper is actuatable by a pivoting movement of a gripper shaft. The gripper housing and the gripper pad are pivotably disposed on the gripper shaft and are jointly pivotable about an axis of the gripper shaft under a prescribed periphery.

12 Claims, 6 Drawing Sheets

APPARATUS FOR TRANSPORTING SHEETS WITH A GRIPPER DEVICE

CROSS-REFERENCE TO RELATED APPLICATION

This application claims the priority, under 35 U.S.C. §119, of German Patent Application DE 10 2006 008 659.7, filed Feb. 27, 2006; the prior application is herewith incorporated by reference in its entirety.

BACKGROUND OF THE INVENTION

Field of the Invention

The invention relates to an apparatus for transporting sheets in or to a sheet-processing machine, in particular a printing press, with a reciprocatingly movable gripper device.

A problem of reciprocatingly movable gripper devices is that they have to be moved along the sheet into an initial or starting position of the gripper devices on a return path thereof, that is to say, after the delivery of a sheet to a further transport apparatus, and can collide with the sheet which has just been transferred, in particular the underside of that sheet. That collision can lead to damage of the sheet.

German Published, Non-Prosecuted Application DE 102 18 172 A1, corresponding to European Patent EP 1 356 932 B1, has disclosed a pregripper device which is seated cyclically pivotable on a pivoting lever and is mounted by a pivotable guide so that it is lowerable in such a manner that the gripper device, on the return path from a sheet delivery site, describes a return path extending below the sheet path.

German Published, Non-Prosecuted Application DE 198 31 976 A1, corresponding to U.S. Pat. No. 6,349,935, shows an alternative configuration. In that configuration, the gripper device of a pregripper is seated on the end of a pivotable coupler which, in turn, is disposed at the end of the pregripper lever. A second end of the coupler is connected to a pivotable guide lever having a pivot point which is cyclically displaceable. Due to that feature, the coupler, whereon the gripper device is fastened, is tilted. That tilting movement causes the gripper device to describe a different path than on the sheet transport path, on the return path from a sheet delivery site to a sheet accepting site.

SUMMARY OF THE INVENTION

It is accordingly an object of the invention to provide an apparatus for transporting sheets with a gripper device, which overcomes the hereinafore-mentioned disadvantages of the heretofore-known apparatuses of this general type and in which the gripper device does not touch the sheet on the return path.

With the foregoing and other objects in view, there is provided in accordance with the invention, an apparatus for transporting sheets to or in a sheet-processing machine having a gripper device. The apparatus comprises at least one respective gripper including a gripper housing and a gripper pad. The respective gripper is to be actuated by a pivoting movement of a gripper shaft having a longitudinal axis. The gripper housing and the gripper pad are pivotably disposed on the gripper shaft and jointly pivotable about an axis of the gripper shaft under a prescribed periphery.

In accordance with another feature of the invention, the apparatus further includes a clamping member fixed on the gripper shaft for the respective gripper.

In accordance with an added feature of the invention, the gripper housing has an abutment and the gripper pad has a stop. The clamping member has a stop for cooperating with the abutment of the gripper housing, and has an abutment for cooperating with the stop of the gripper pad.

In accordance with a further feature of the invention, the stops are adjustable.

In accordance with an additional feature of the invention, the gripper pad has a stop for fixing sheet transport in position. The stop serves for cooperating with an abutment of a carriage or a lever.

In accordance with yet another feature of the invention, the last-mentioned stop is adjustable.

In accordance with yet a further feature of the invention, the apparatus includes guide elements for prescribing the periphery.

In accordance with yet an added feature of the invention, the lever is a bearing lever of a pregripper drivable cyclically in synchronism with the sheet-processing machine. The gripper device is disposed on the bearing lever of the pregripper.

In accordance with yet an additional feature of the invention, the carriage is a carriage of a feeding device drivable cyclically reciprocable in synchronism with the sheet-processing machine. The gripper device is disposed on the carriage of the feeding device.

In accordance with a concomitant feature of the invention, the sheet-processing machine is a rotary printing press.

It is a particular advantage of the invention that a gripper housing and a gripper pad are disposed on a common gripper shaft, with the gripper shaft describing the same movement path during the reciprocating movement.

In order to produce this movement path, it is advantageous to employ a linear drive, in particular a linear drive which is electromagnetically driven.

In order to pivot the gripper tip together with the gripper pad below a prescribable or predefinable limit, provision is made, in a simple improvement or refinement, for the gripper housing to be provided with a further stop which cooperates or interacts with an abutment of the gripper pad in such a manner that the latter is pivoted from a first position for sheet transport into a second position for the return movement.

Other features which are considered as characteristic for the invention are set forth in the appended claims.

Although the invention is illustrated and described herein as embodied in an apparatus for transporting sheets with a gripper device, it is nevertheless not intended to be limited to the details shown, since various modifications and structural changes may be made therein without departing from the spirit of the invention and within the scope and range of equivalents of the claims.

The construction and method of operation of the invention, however, together with additional objects and advantages thereof will be best understood from the following description of specific embodiments when read in connection with the accompanying drawings.

DESCRIPTION OF THE PREFERRED EMBODIMENTS

Figure 1:
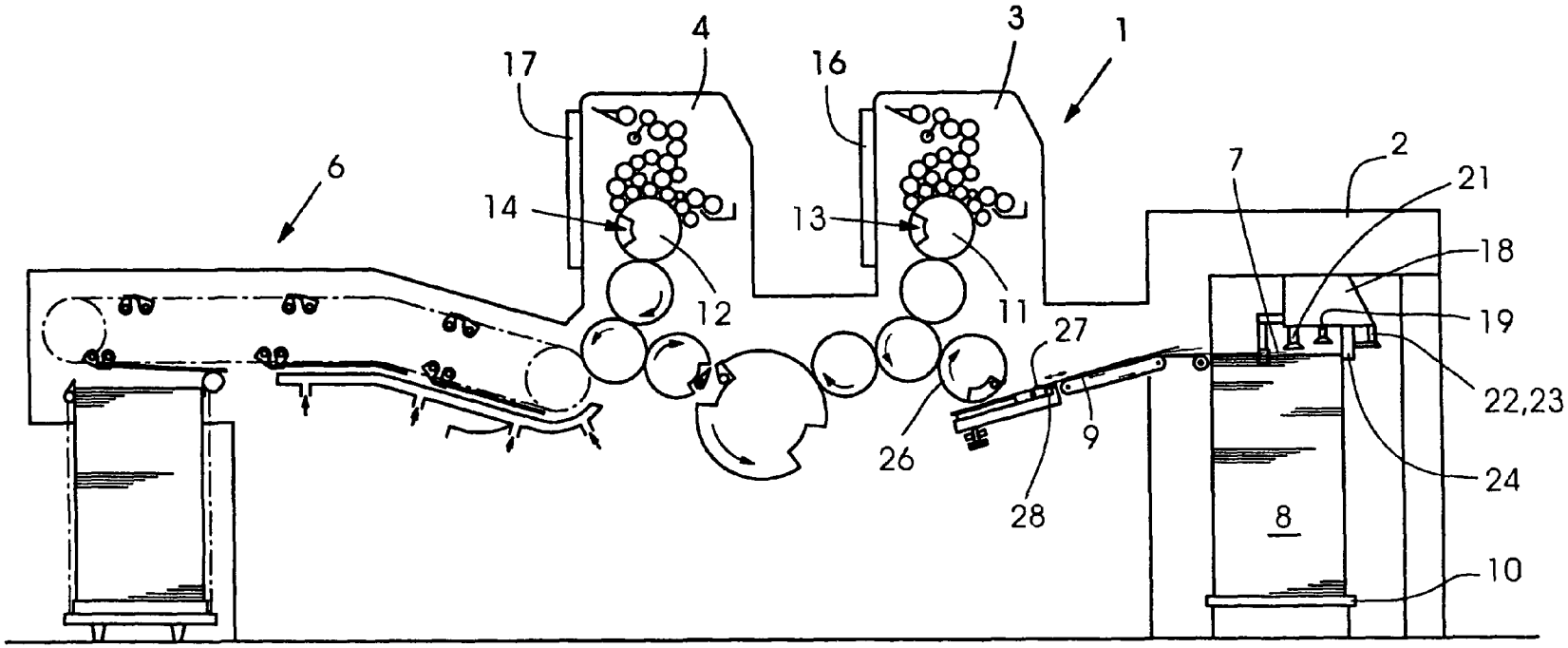
FIG. 1 is a diagrammatic, longitudinal-sectional view of a sheet-fed rotary printing press.

Referring now to the figures of the drawings in detail and first, particularly, to FIG. 1 thereof, there is seen a sheet-processing machine, for example, a printing press 1, having a feeder 2, at least one respective printing unit 3 or 4 and a delivery 6. Sheets 7 are removed from a sheet pile 8 and fed to the printing units 3 and 4 over a feed table 9, singly or in an imbricated or overlapping manner. The printing units-3 and 4 respectively include a respective plate cylinder 11, 12, in a conventional manner. The plate cylinders 11 and 12 respectively have a respective device 13, 14 for fastening flexible printing plates. Moreover, each plate cylinder 11, 12 has assigned thereto a respective device 16, 17 for semiautomatic or fully automatic printing-plate exchanging.

The sheet pile 8 lies on a pile board 10 which can be raised in a controlled manner. The sheets 7 are removed from an upper side of the sheet pile 8 by a so-called suction head 18 which, amongst others things, has a number of lifting suckers 19 and dragging suckers 21 for separating or singling the sheets 7. Moreover, blowing devices 22 are provided for loosening an upper sheet contact, and sensing elements 23 are provided for sheet tracking. A number of lateral and rear stops 24 are also provided for aligning the sheet pile 8, particularly the upper sheet 7 of the sheet pile 8.

Figure 2:
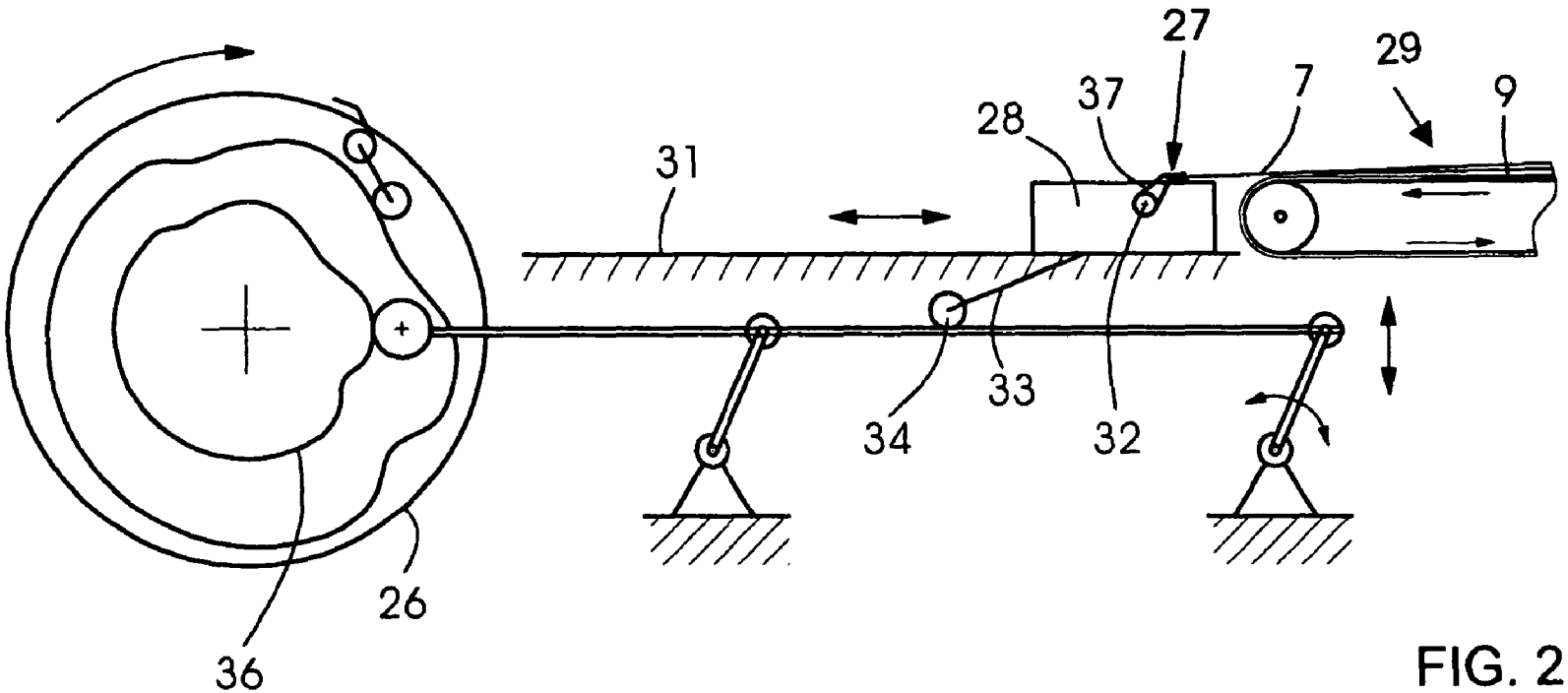
FIG. 2 is a fragmentary, enlarged, longitudinal-sectional view of a device for actuating a gripper opening and closing movement for a linearly driven gripper device.

In a first exemplary embodiment according to FIG. 2, provision is made for a carriage 28 to be used with a linear drive 29 for transferring the sheet 7 from the feed table 9 to a feed cylinder 26. The carriage 28, which moves reciprocatingly in guides 31, carries a gripper device 27.

Figure 3:
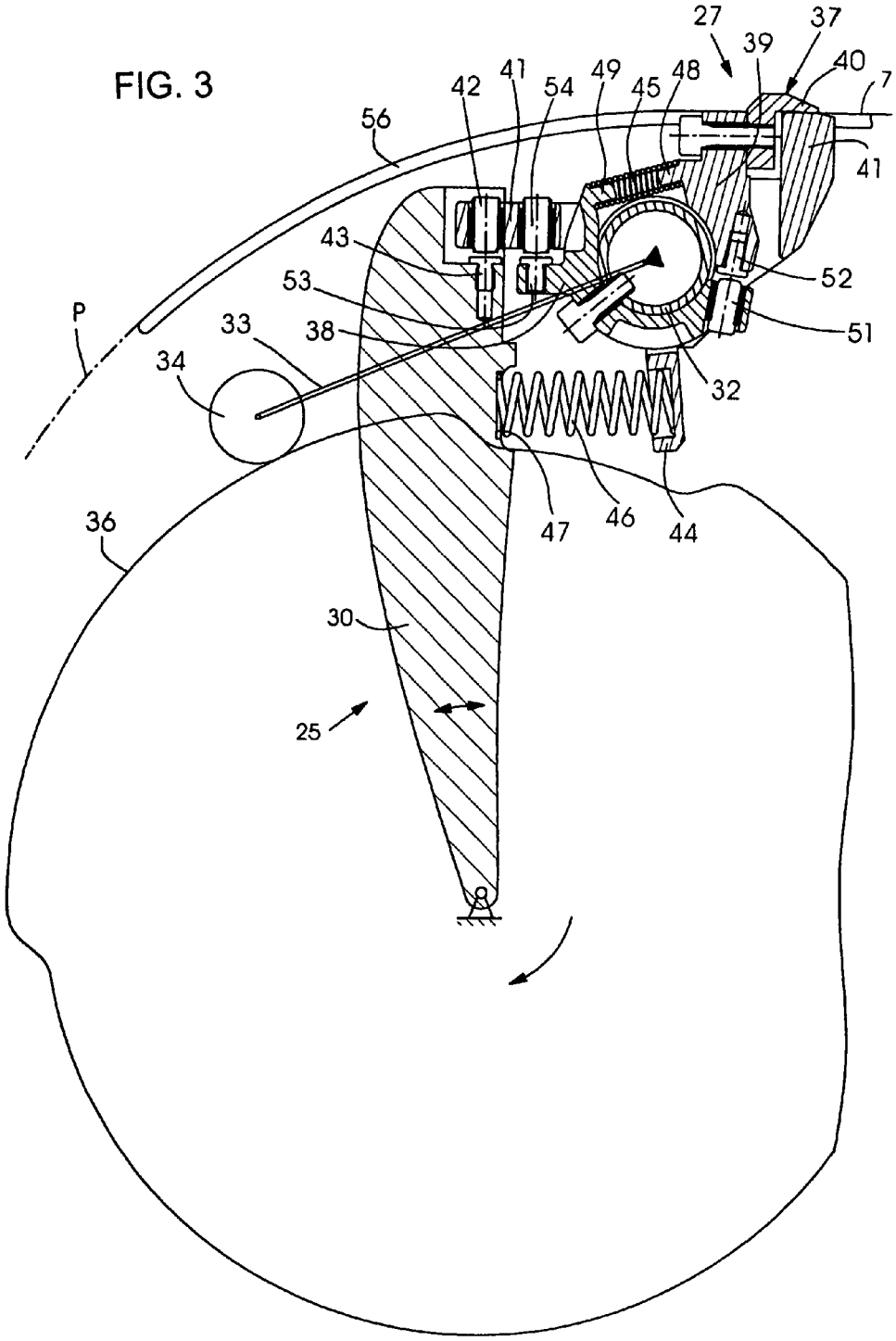
FIG. 3 is a fragmentary, sectional view of a device for actuating a gripper opening and closing movement for a conventional pregripper.

In a second exemplary embodiment according to FIG. 3, provision is made for the sheet 7 to be transferred from the feed table 9 to the feed cylinder 26 by a so-called "pregripper" 25. The pregripper 25 basically includes a bearing lever 30 which reciprocatingly moves cyclically in synchronism with the machine and carries a gripper device 27 at an end thereof.

The construction of the gripper device 27 of the carriage 28 and of the pregripper 25 is basically identical and will therefore be described jointly below.

The gripper device 27 includes a gripper shaft 32 which is pivotably mounted on the carriage 28 or on the pregripper 25 and carries a control lever 33 at one end thereof. The control lever 33 has a rotatably mounted control roller 34 which is operatively connected directly or indirectly to a control cam 36 driven in synchronism with the operation of the sheet-processing machine.

The control cam 36 produces pivoting movements of the gripper shaft 32, which effects an opening and closing movement of the gripper device 27.

A number of individual grippers 37 are seated adjacent and spaced apart from one another on the gripper shaft 32. Each individual gripper 37 has a clamping member 38 fixedly connected to the gripper shaft 32, and a gripper housing 39 pivotably disposed on the gripper shaft 32 and having a gripper tip 40, which is also pivotable with respect to the gripper shaft 32. Moreover, a gripper pad 41 is pivotably disposed on the gripper shaft 32.

The gripper tip 40 and the gripper pad 41 cooperate for transporting the sheet 7.

The gripper housing 39 is disposed so as to be pivotable independently of the gripper pad 41 for the respective gripper opening movement and gripper closing movement. The gripper housing 39 and the gripper pad 41 are disposed so as to be pivotable jointly around the axis of the gripper shaft 32, for the purpose of a dipping movement of the individual grippers 37 under a predescribed or predefined periphery P.

Figure 4:
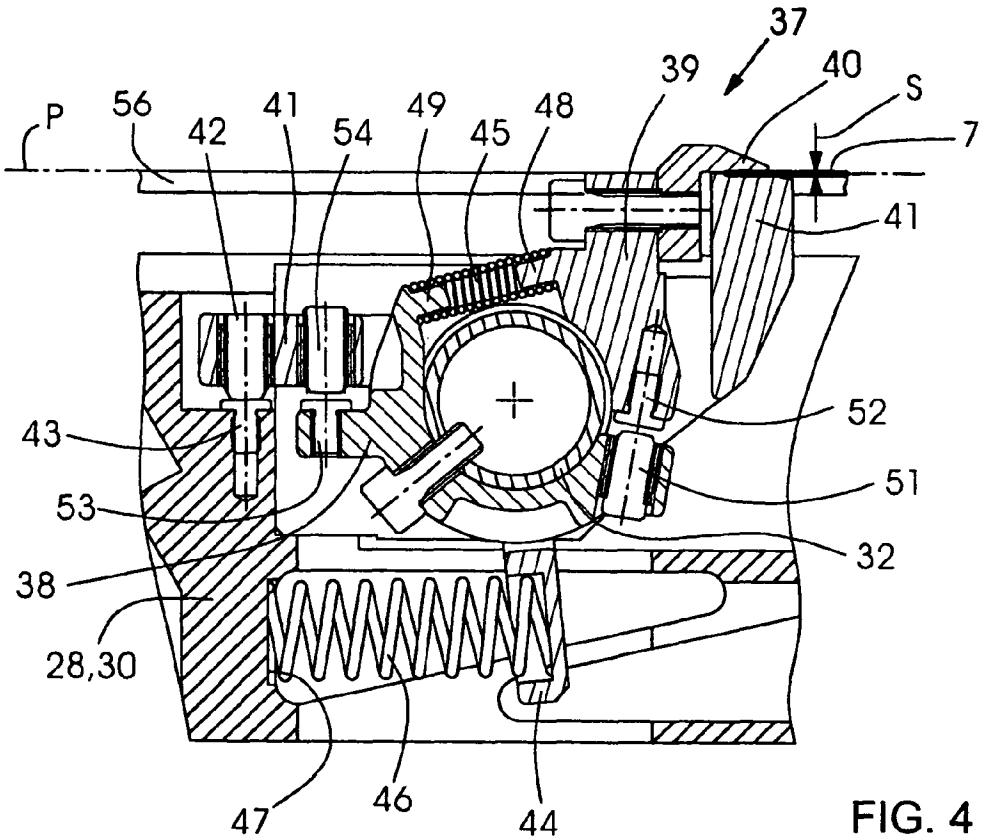
FIG. 4 is a fragmentary, sectional view of the gripper device during sheet transport.

In order to position the gripper pad 41 in a sheet transport position according to FIG. 4, the gripper pad 41 has a first adjustable stop 42 which cooperates with an abutment 43 on the carriage 28 or on the pregripper bearing lever 30.

A second stop 44 of the gripper pad 41 is loaded with force in a counterclockwise direction by a prestressed compression spring 46. The compression spring 46 is supported on an abutment 47 of the respective carriage 28 or pregripper bearing lever 30, and consequently ensures contact of the first stop 42 on the abutment 43.

The grippers 37 are closed in the sheet transport position, i.e., the gripper tip 40 is pressed against the gripper pad 41 by the force of a prestressed compression spring 45. The spring 45 is supported between a first abutment 48 of the gripper housing 39 and a second abutment 49 of the clamping member 38.

An adjustable stop 51 on the clamping member 38, and a second abutment 52 on the gripper housing 39 cooperating therewith, define a gap S between the gripper tip 40 and the gripper pad 41, in order to adjust or set a sheet thickness.

Figure 5:
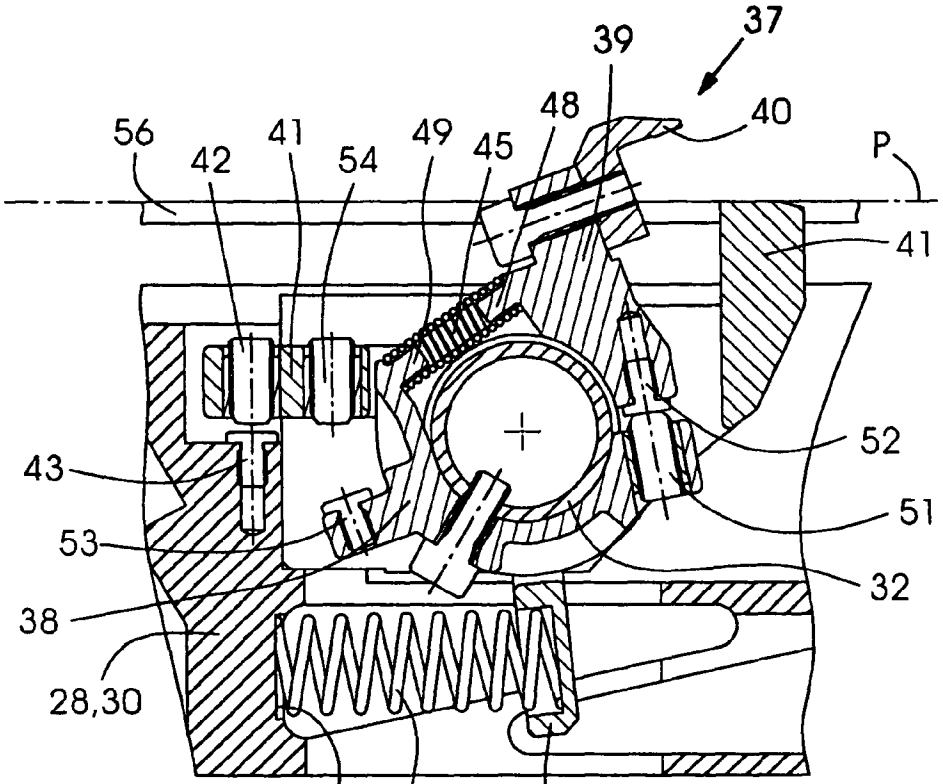
FIG. 5 is a view similar to FIG. 4, showing the gripper device in an opened position.

In order to open the grippers 37 in a respective sheet transfer position and sheet accepting position, the gripper shaft 32 is pivoted in a counterclockwise direction according to FIG. 5, due to the contour of the control cam 36. The stop 51 thereby presses the gripper housing 39 due to the abutment 52 into an open position in the counterclockwise direction. A second abutment 53 of the clamping piece 38 is thereby spaced apart from a third adjustable stop 54 of the gripper pad 41. The gripper pad 41 consequently remains in the sheet transport position.

Figure 6:
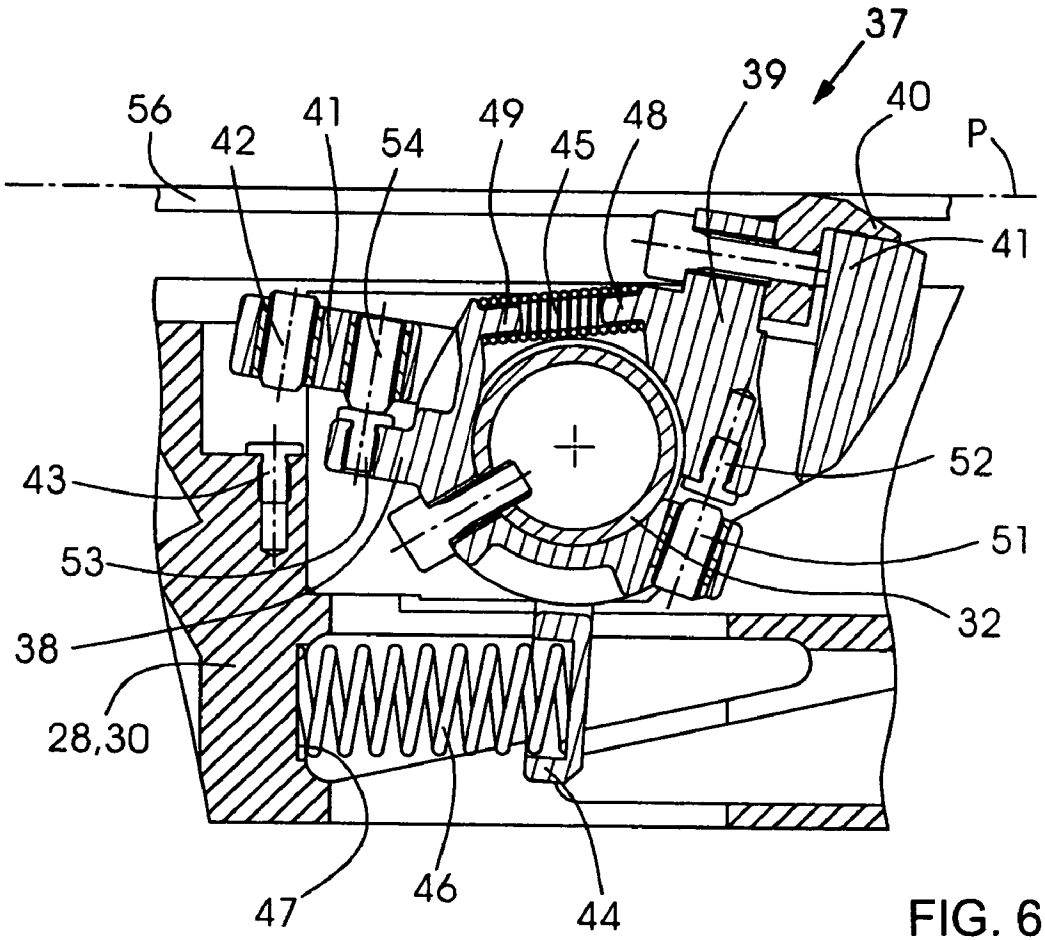
FIG. 6 is a view similar to FIGS. 4 and 5, showing the gripper device during a return movement.

After a sheet has been transferred to the feed cylinder 26, which may also be an impression cylinder, the gripper device 27 is moved back into the sheet accepting position. Provision is consequently made, in accordance with FIG. 6, for the gripper housing 39 with the gripper tip 40 and the gripper pad 41 to be pivoted in clockwise direction until they are lowered below the predefined periphery P, for example below an upper edge of guide straps 56 which are disposed in a stationary configuration between the individual grippers 37.

In order to produce this pivoting movement, the gripper shaft 32 with the clamping member 38 is pivoted in the clockwise direction. The abutment 53 of the clamping piece 38 consequently presses against the stop 54 of the gripper pad 41 and pivots the gripper pad 41 counter to the force of the compression spring 46. The gripper tip 40 is driven by the compression spring 45, in contact with the gripper stop 41 or through the abutment 52 and the stop 51, until all of the parts of the individual grippers 37 are situated below the periphery P. This measure precludes a collision with the sheet which is further transported by the feed cylinder 26, because the sheet is always guided above the periphery P.

We claim:

1. An apparatus for transporting sheets to or in a sheet-processing machine, the apparatus comprising:

a gripper device including a gripper shaft having a longitudinal axis and at least one gripper to be actuated by a pivoting movement of said gripper shaft;

said at least one gripper having a gripper housing with a gripper tip and a gripper pad, said gripper housing with said gripper tip and said gripper pad being pivotably disposed on said gripper shaft and being jointly pivotable; a single control cam disposed adjacent said gripper device;

a control lever mounted to said gripper shaft, said control lever being operatively connected to said single control cam for producing the pivoting movement of said gripper shaft;

said single control cam for producing the pivoting movement of said gripper housing, said gripper tip, and said gripper pad about said axis of said gripper shaft under a prescribed periphery and said single control cam controlling an opening or closing movement of said gripper tip and said gripper pad.

2. The apparatus according to claim 1, which further comprises a clamping member fixed on said gripper shaft for said at least one gripper.

3. The apparatus according to claim 2, wherein:

said gripper housing has an abutment;

said gripper pad has a stop; and said clamping member has a stop for cooperating with said abutment of said gripper housing for opening said gripper device and an abutment for cooperating with said stop of said gripper pad for pivoting said gripper device.

4. The apparatus according to claim 3, wherein said stops are adjustable.

5. The apparatus according to claim 1, which further comprises a carriage having an abutment, said gripper pad having a stop for fixing sheet transport in position, said stop of said gripper pad cooperating with said abutment of said carriage.

6. The apparatus according to claim 1, which further comprises a lever having an abutment, said gripper pad having a stop for fixing sheet transport in position, said stop of said gripper pad cooperating with said abutment of said lever.

7. The apparatus according to claim 5, wherein said stop is adjustable.

8. The apparatus according to claim 6, wherein said stop is adjustable.

9. The apparatus according to claim 1, which further comprises guide elements for prescribing said periphery.

10. The apparatus according to claim 1, which further comprises a pregripper to be driven cyclically in synchronism with the sheet-processing machine, said pregripper having a bearing lever, and said gripper device being disposed on said bearing lever.

11. The apparatus according to claim 1, which further comprises a feeding device to be driven cyclically back and forth in synchronism with the sheet-processing machine, said feeding device having a carriage, and said gripper device being disposed on said carriage.

12. The apparatus according to claim 1, wherein the sheet-processing machine is a rotary printing press.

* * * * *